US011569581B2

(12) United States Patent
Huang et al.

(10) Patent No.: US 11,569,581 B2
(45) Date of Patent: Jan. 31, 2023

(54) TRANSMISSION STRUCTURE WITH DUAL-FREQUENCY ANTENNA

(71) Applicant: Arcadyan Technology Corporation, Hsinchu (TW)

(72) Inventors: Chih-Yung Huang, Taichung (TW); Kuo-Chang Lo, Miaoli County (TW)

(73) Assignee: ARCADYAN TECHNOLOGY CORPORATION

( * ) Notice: Subject to any disclaimer, the term of this patent is extended or adjusted under 35 U.S.C. 154(b) by 0 days.

(21) Appl. No.: 17/465,660

(22) Filed: Sep. 2, 2021

(65) Prior Publication Data

US 2022/0094062 A1 Mar. 24, 2022

(30) Foreign Application Priority Data

Sep. 23, 2020 (TW) ..... 109132891

(51) Int. Cl.
*H01Q 9/28* (2006.01)
*H01Q 1/38* (2006.01)
*H01Q 5/371* (2015.01)

(52) U.S. Cl.
CPC ..... *H01Q 9/285* (2013.01); *H01Q 1/38* (2013.01); *H01Q 5/371* (2015.01)

(58) Field of Classification Search
CPC ..... H01Q 9/285; H01Q 9/28; H01Q 9/065
See application file for complete search history.

(56) References Cited

U.S. PATENT DOCUMENTS 7,145,517 B1 * 12/2006 Cheng ..... H01Q 1/2291 343/810
7,218,287 B2 * 5/2007 Hung ..... H01Q 1/2266 343/700 MS
7,242,352 B2 7/2007 Hosouri
(Continued)

FOREIGN PATENT DOCUMENTS

CN 2741206 Y 11/2005
KR 10-2008-0095597 A 10/2008
(Continued)

OTHER PUBLICATIONS

Communication from European Patent Office for European Application No. 21198340.8, dated Feb. 17, 2022, 9 pages.
(Continued)

*Primary Examiner* — Ab Salam Alkassim, Jr.
(74) *Attorney, Agent, or Firm* — Innovation Counsel LLP

(57) ABSTRACT

A transmission structure with a dual-frequency antenna is provided. The transmission structure includes a substrate, a first radiator and a second radiator. The first radiator has a first electrical connection portion. The first radiator extends from the first electrical connection portion in a first direction and a second direction, wherein the first direction is opposite to the second direction. The second radiator has a second electrical connection portion adjacent to the first electrical connection portion. The second electrical connection portion has a first side and a second side, wherein the first side is closer to the first electrical connection portion than the second side, the second electrical connection portion forms a ground area between the first side and the second side, and the length of the ground area is greater than a first set value.

9 Claims, 3 Drawing Sheets

(56) References Cited

U.S. PATENT DOCUMENTS

| | | | | |
|---|---|---|---|---|
| 7,256,743 | B2 | 8/2007 | Korva | |
| 7,432,859 | B2 * | 10/2008 | Zinanti | H01Q 9/04 343/700 MS |
| 7,501,991 | B2 * | 3/2009 | Yeap | H01Q 9/26 343/700 MS |
| 7,548,214 | B2 * | 6/2009 | Chou | H01Q 9/16 343/700 MS |
| 9,614,287 | B2 * | 4/2017 | Urso | H01Q 9/26 |
| 10,103,451 | B2 * | 10/2018 | Dorsey | H01Q 1/48 |
| 10,243,251 | B2 * | 3/2019 | Gok | H01Q 1/38 |
| 10,868,354 | B1 * | 12/2020 | He | H01Q 1/243 |
| 2003/0231139 | A1 * | 12/2003 | Tai | H01Q 5/371 343/795 |
| 2005/0212713 | A1 * | 9/2005 | Dai | H01Q 21/30 343/792 |
| 2005/0243007 | A1 * | 11/2005 | Ke | H01Q 5/371 343/792 |
| 2011/0221648 | A1 * | 9/2011 | Lee | H01Q 9/285 343/826 |
| 2011/0279341 | A1 * | 11/2011 | Chang | H01Q 5/392 343/822 |
| 2012/0169560 | A1 * | 7/2012 | Lee | H01Q 9/30 343/770 |
| 2012/0176289 | A1 * | 7/2012 | Lee | H01Q 5/371 343/793 |
| 2014/0132469 | A1 * | 5/2014 | Wang | H01Q 1/2266 343/821 |
| 2015/0102974 | A1 | 4/2015 | Stoytchev et al. | |
| 2015/0194729 | A1 * | 7/2015 | Huang | H01Q 5/371 343/843 |
| 2016/0190681 | A1 * | 6/2016 | Huang | H01Q 13/10 343/848 |
| 2017/0012356 | A1 * | 1/2017 | Huang | H01Q 9/04 |
| 2017/0033459 | A1 * | 2/2017 | Tsai | H01Q 9/065 |
| 2017/0085002 | A1 * | 3/2017 | Huang | H01Q 1/38 |
| 2017/0162939 | A1 * | 6/2017 | Huang | H01Q 1/38 |
| 2017/0162942 | A1 * | 6/2017 | Wu | H01Q 9/42 |
| 2019/0058252 | A1 * | 2/2019 | Kuo | H01Q 9/16 |
| 2019/0334254 | A1 * | 10/2019 | Wu | H01Q 1/521 |
| 2020/0274243 | A1 * | 8/2020 | Zhao | H01Q 5/307 |
| 2021/0091466 | A1 * | 3/2021 | Wu | H01Q 5/50 |
| 2021/0151858 | A1 * | 5/2021 | Wu | H01Q 1/243 |
| 2022/0255825 | A1 * | 8/2022 | Yang | H04W 24/04 |

FOREIGN PATENT DOCUMENTS

| | | | |
|---|---|---|---|
| TW | M260011 | U | 3/2005 |
| TW | M325616 | U | 1/2008 |
| TW | I333715 | B | 11/2010 |
| TW | I351787 | B | 11/2011 |
| TW | 201907618 | A | 2/2019 |
| TW | 202013813 | A | 4/2020 |

OTHER PUBLICATIONS

Communication corresponding to Taiwan Application No. 109132891 and issued by Taiwan Intellectual Property Office dated Feb. 24, 2021, 6 pages.

* cited by examiner

TRANSMISSION STRUCTURE WITH DUAL-FREQUENCY ANTENNA

This application claims the benefit of Taiwan application Ser. No. 109132891, filed Sep. 23, 2020, the subject matter of which is incorporated herein by reference.

BACKGROUND OF THE INVENTION

Field of the Invention

The invention relates in general to an antenna, and more particularly to a transmission structure with a dual-frequency antenna.

Description of the Related Art

In response to the current design of electronic products being directed towards light weight, small size and slimness, various circuit elements inside the electronic products tend to be miniaturized, and the antenna disposed inside the electronic products needs to support multi-frequency applications and the size of the antenna also needs to be miniaturized. Particularly, in the application fields such as broadband network and multi-media services, the dual-frequency antenna can provide two resonance modes, such that the dual-frequency antenna can operate between two different resonance bands and cover an even larger frequency band.

Therefore, it has become a prominent task for the industries to provide a dual-frequency antenna which can be used on a printed circuit board and makes the required frequency of the antenna easily adjusted to the required frequency band of the wireless local area network.

SUMMARY OF THE INVENTION

The invention is directed to a transmission structure with a dual-frequency antenna. When the transmission structure is used on a printed circuit board, the required frequency of the antenna can be easily adjusted.

According to one embodiment of the present invention, a transmission structure with a dual-frequency antenna is provided. The transmission structure includes a substrate, a first radiator and a second radiator. The first radiator has a first electrical connection portion. The first radiator extends from the first electrical connection portion in a first direction and a second direction, wherein the first direction is opposite to the second direction. The second radiator has a second electrical connection portion adjacent to the first electrical connection portion. The second electrical connection portion has a first side and a second side, wherein the first side is closer to the first electrical connection portion than the second side, the second electrical connection portion forms a ground area between the first side and the second side, and the length of the ground area is greater than a first set value.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements. Directional terms such as above, under, left, right, front or back are used in the following embodiments to indicate the directions of the accompanying drawings, not for limiting the present invention.

According to an embodiment of the invention, a printed 5G/Sub6G broadband antenna and a transmission structure thereof are provided. The printed 5G/Sub6G broadband antenna can easily adjust the frequency band to achieve system application. Signal is fed to the antenna through the design in which a 50 Ohm (Ω) electric cable is soldered to an antenna feed point, and another end of the cable can extend to a radio frequency communication module. In the present embodiment, the system adopts a printed broadband antenna and therefore dispenses with the mold cost and assembly cost as required by a 3D antenna and avoids the deformation risk associated with the 3D antenna. The printed broadband antenna advantageously provides several choices in terms of application. For example, the printed broadband antenna can be used on an independent printed circuit board or can work with the system. The printed broadband antenna has an independent adjustment mechanism which meets versatile applications of different systems.

Figure 1:
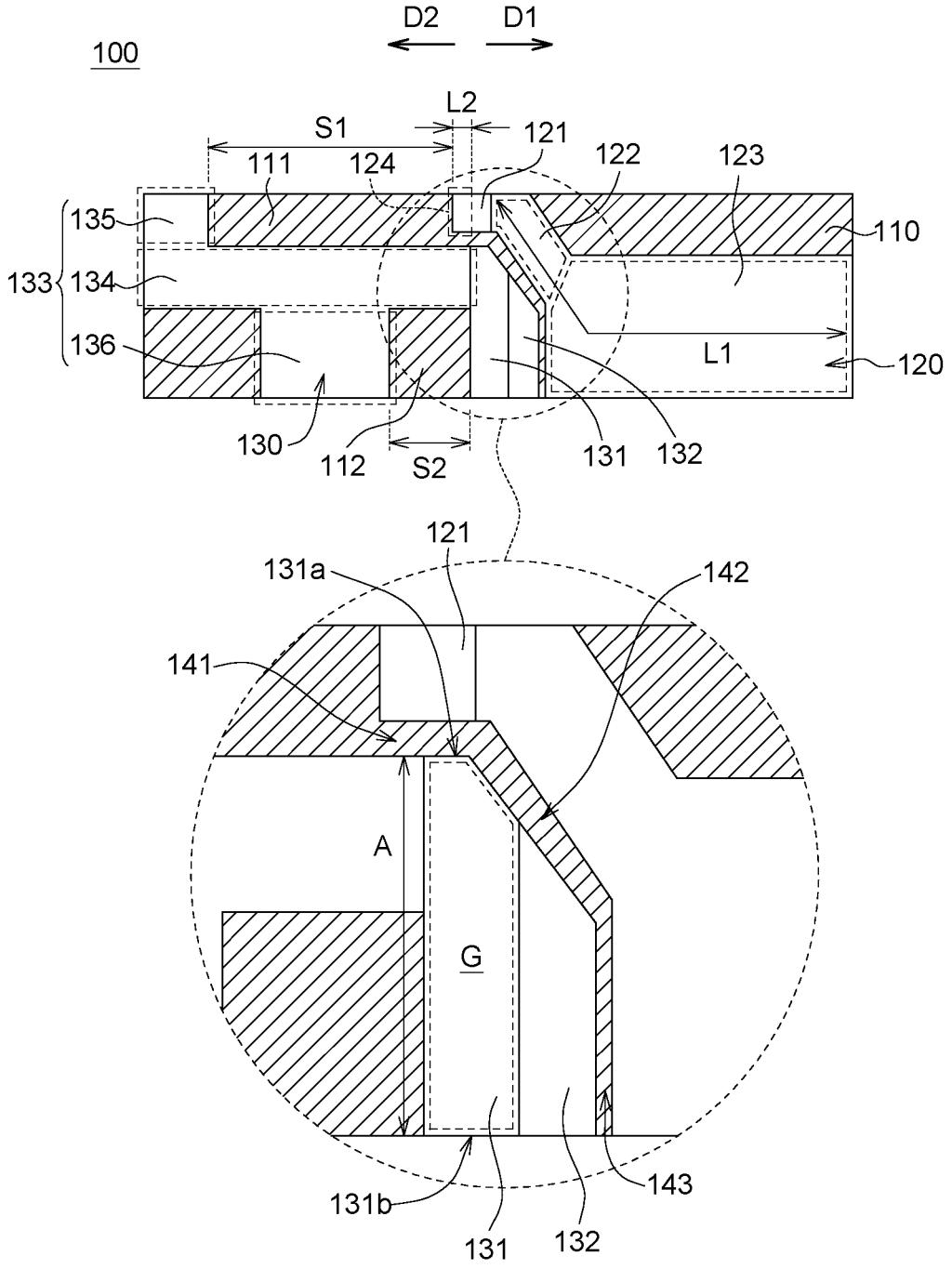
FIG. 1 is a schematic diagram and a partial enlarged view of a dual-frequency antenna according to an embodiment of the invention.

Referring to FIG. 1, a schematic diagram and a partial enlarged view of a dual-frequency antenna 100 according to an embodiment of the invention are shown. The dual-frequency antenna 100 includes a substrate 110, a first radiator 120 and a second radiator 130. The substrate 110 is a dielectric material for manufacturing a printed circuit board. The first radiator 120 and the second radiator 130 are integrally formed on a surface of the substrate 110 to form a printed antenna structure. The first radiator 120 has a first electrical connection portion 121 used as a signal feed point. The second radiator 130 has a second electrical connection portion 131 adjacent to the first electrical connection portion 121. The second electrical connection portion 131 can be used as a ground area.

The first radiator 120 extends from the first electrical connection portion 121 in a first direction D1 and a second direction D2, wherein the first direction D1 is opposite to the second direction D2. Besides, the first radiator 120 extends a deflection portion 122 and a first extension block 123 in the first direction D1; the deflection portion 122 is connected between the first electrical connection portion 121 and the first extension block 123; and the first extension block 123 can be used as a radio frequency emitter for low frequency signal, such as within a 4G/LTE frequency band. Furthermore, the first radiator 120 extends a second extension block 124 in the second direction D2. The second extension block 124 can be used as a radio frequency emitter for high frequency signal, such as within a 5G/Sub6G frequency band.

In an embodiment, the first radiator 120 extends a first length L1 from the first electrical connection portion 121 in the first direction D1, wherein the first length L1 is equivalent to the sum of the length of the deflection portion 122 and the length of the first extension block 123. The first length L1 depends on the required length for the first radiator 120 to excite the electromagnetic wave of the first wave band. For example, the first length L1 is approximately equivalent to ¼ of the wavelength of the first wave band. The first length L1 is between 25 mm and 45 mm; the frequency of the first wave band is between 1710 MHz and 2690 MHz.

Moreover, the first radiator 120 extends a second length L2 from the first electrical connection portion 121 in the second direction D2, wherein the second length L2 is equivalent to the length of the second extension block 124. The second length L2 depends on the required length for the first radiator 120 to excite the electromagnetic wave of the second wave band. For example, the second length L2 is approximately equivalent to ¼ of the wavelength of the second wave band. The second length L2 is between 12 mm and 18 mm; the frequency of the second wave band is between 3200 MHz and 4500 MHz.

Refer to FIG. 1. The second electrical connection portion 131 has a first side 131*a* and a second side 131*b*. The first side 131*a* is closer to the first electrical connection portion 121 than the second side 131*b*, that is, the first side 131*a* is adjacent to the first electrical connection portion 121. A groove 141 is formed between the first side 131*a* and the first electrical connection portion 121 and is used to adjust the impedance matching of the dual-frequency antenna 100.

Figure 2:
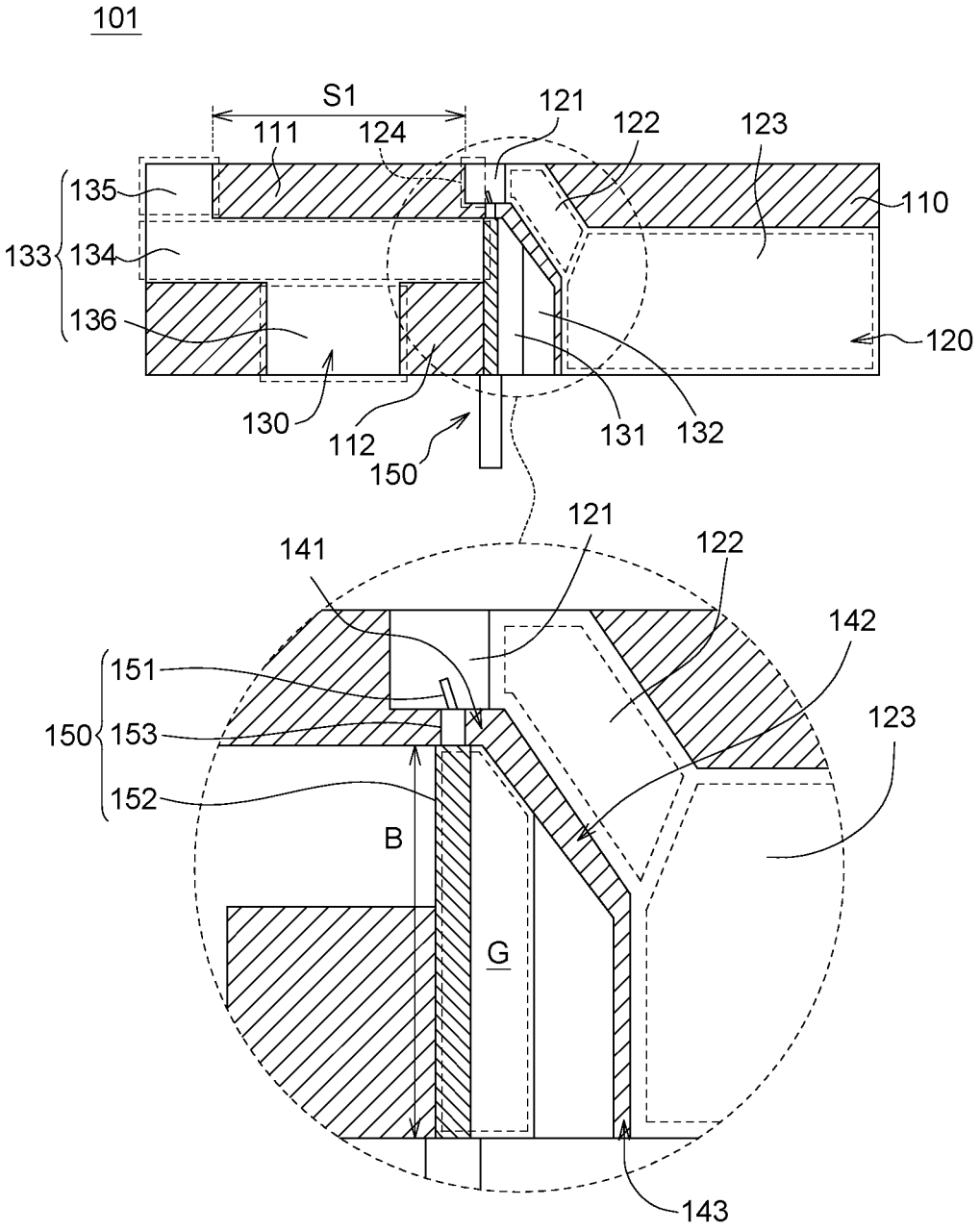
FIG. 2 is a schematic diagram and a partial enlarged view of a transmission structure with a dual-frequency antenna according to an embodiment of the invention.

Besides, the second electrical connection portion 131 has a ground area G formed between the first side 131*a* and the second side 131*b*. A cable 150 overlaps the ground area G which can have a long strip shape. The appearance of the cable 150 is as indicated in FIG. 2. The length A of the ground area G is greater than a first set value, that is, the distance between the first side 131*a* and the second side 131*b* is greater than a first set value, such as 10 mm.

Moreover, the second radiator 130 extends from the second electrical connection portion 131 in a first direction D1 and a second direction D2. For example, the second radiator 130 extends a first adjustment block 132 in the first direction D1. The first adjustment block 132 is adjacent to the deflection portion 122 and the first extension block 123 of the first radiator 120. A first groove 142 is formed between the first adjustment block 132 and deflection portion 122. A second groove 143 is formed between the first adjustment block 132 and the first extension block 123. The first groove 142 and the second groove 143 are interconnected.

In an embodiment, the first groove 142 and the second groove 143 can be used to adjust the impedance matching of the dual-frequency antenna 100; the width of the first groove 142 and the width of the second groove 143 can be designed to be identical or different. The width of the first groove 142 is between 0.95 mm and 1.15 mm; the width of the second groove 143 is between 0.6 mm and 0.8 mm.

Moreover, the second radiator 130 extends a second adjustment block 133 in the second direction D2. The second adjustment block 133 can be used as a ground surface of the substrate 11 (i.e., independent ground). The second adjustment block 133 includes a first sub-block 134, a second sub-block 135 and a third sub-block 136. The first sub-block 134 is located between the second sub-block 135 and third sub-block 136. The second sub-block 135 and the third sub-block 136 extends two opposite sides of the first sub-block 134. Basically, the first sub-block 134 and the second sub-block 135 form an L-shaped block; the first sub-block 134 and the third sub-block 136 form a T-shaped block.

In the present embodiment, the second sub-block 135 and the second extension block 124 are opposite to each other and are separated by a first distance S1 (corresponding to the area 111 of the substrate 110); the third sub-block 136 and the second electrical connection portion 131 are opposite to each other and are separated by a second distance S2 (corresponding to the area 112 of the substrate 110). The first distance S1 is greater than the second distance S2, wherein the first distance S1 is between 14 mm and 24 mm, and the second distance S2 is between 6.0 mm and 6.7 mm.

FIG. 2 is a schematic diagram and a partial enlarged view of a transmission structure 101 with a dual-frequency antenna 100 according to an embodiment of the invention. In the present embodiment, a cable 150 is disposed on the substrate 110 to feed a signal to the first electrical connection portion 121. The signal feeding direction is perpendicular to the first direction D1 and the second direction D2. That is, the signal feeding direction is substantially perpendicular to the extending direction of the first radiator 120 and the second radiator 130.

The cable 150 is a coaxial electric cable 150. The cable 150 includes a central core (current end 151) through which the current flows, a ground conductor (ground end 152) which wraps the central core, and an insulation layer 153 located between the current end 151 and the ground end 152. The current end 151 electrically connects the first electrical connection portion 121. The ground end 152 electrically connects the ground area G of the second electrical connection portion 131. When the current is respectively transferred to the first extension block 123 and the second extension block 124 through the first electrical connection portion 121, radio frequency signals of the first wave band and the second wave band are respectively formed on the two sides of the first radiator 120. In an embodiment as indicated in FIG. 3, the first wave band Wa is between 1710-2690 MHz; the second wave band Wb is between 3200-4500 MHz.

As indicated in FIGS. 1 and 2, the ground end 152 of the cable 150 overlaps the ground area G, and the overlapping length B of the cable 150 is greater than a second set value, such as 9 mm. The second set value is less than or equivalent to the first set value. The ratio of the second set value to the first set value is less than or equivalent to 1, is greater than ½, ⅔ or ¾. For example, the overlapping length B of the cable 150 is greater than ½ of the distance (length A) between the first side 131*a* and the second side 131*b* and preferably is greater than ⅔ or ¾ of the distance A or is almost equivalent to the distance (length A). The overlapping length B of the cable 150 affects the frequency response of the dual-frequency antenna 100. The first extension block 123 of the first radiator 120 can form an effective coupling effect with the ground surface within a distance. The second extension block 124 can form an effective coupling effect with the ground surface within a distance. The overall coupling effect helps to increase the frequency band.

In an embodiment, the overlapping method between the cable 150 and the ground area G includes welding, brazing, soldering), swaging, riveting, and screwing.

Figure 3:
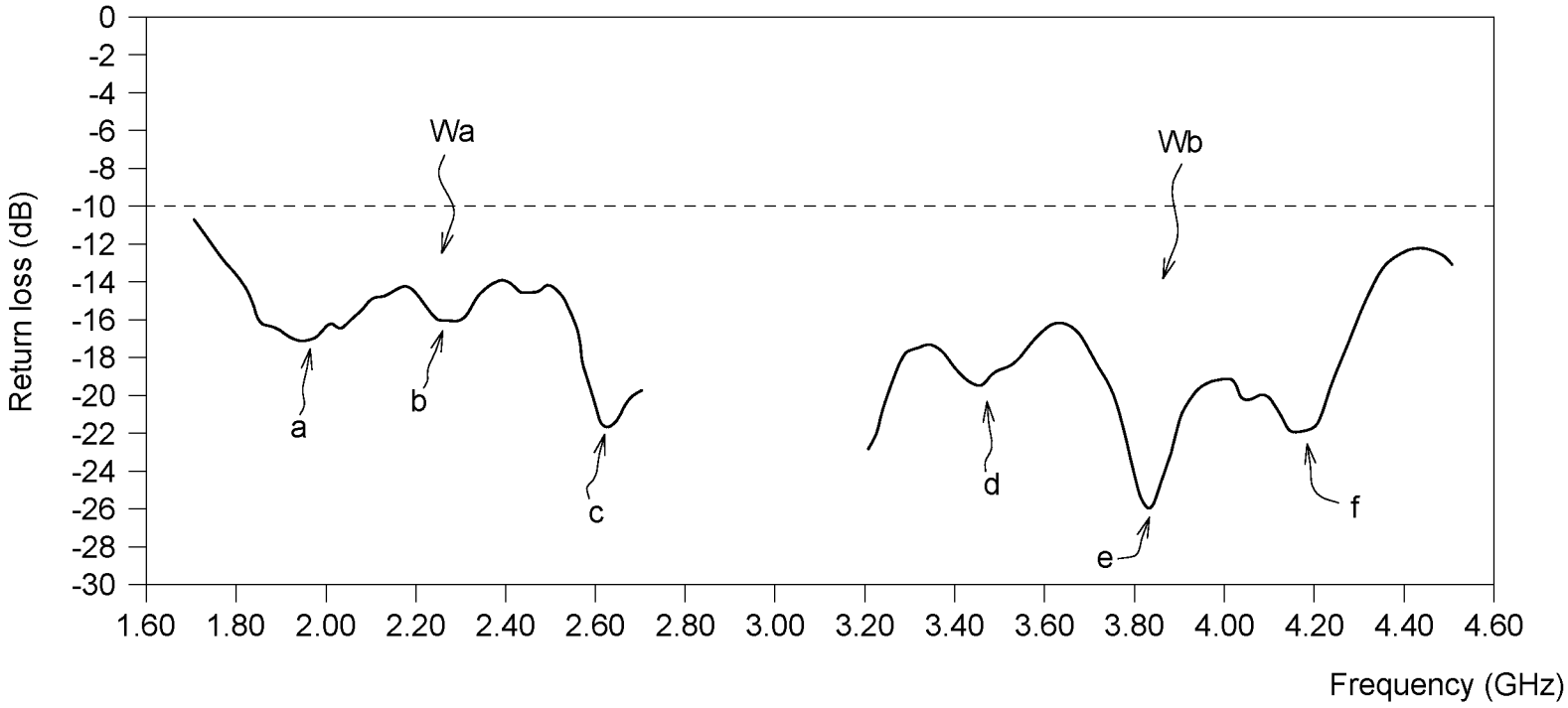
FIG. 3 is a return loss characteristic diagram of a dual-frequency antenna according to an embodiment of the invention.

Referring to FIG. 3, a return loss characteristic diagram of a dual-frequency antenna 100 according to an embodiment of the invention is shown. The return loss characteristic diagram illustrates the wave band and width of the signal within which the dual-frequency antenna 100 can operate. The vertical axis represents return loss (dB). The horizontal axis represents frequency (GHz). The return loss characteristic diagram shows a power ratio of the reflected wave to the incident wave when the antenna operates at a wave band between 1.7 GHz and 2.7 GHz and a wave band between 3.2 GHz and 4.5 GHz. FIG. 3 shows that the antenna can operate at several wave bands less than a particular return loss (−10 dB). In the present embodiment, FIG. 3 shows that the antenna can operate at several wave band positions a, b, c, d, e, and f. For example, the wave band position a appropriately corresponds to 1.9 GHz, the wave band position b appropriately corresponds to 2.3 GHz, the wave band position c appropriately corresponds to 2.6 GHz, the wave band position d appropriately corresponds to 3.4 GHz, the wave band position e appropriately corresponds to 3.8 GHz, and the wave band position f appropriately corresponds to 4.2 GHz.

The fourth-generation mobile network (4G) and the long-term evolution (LTE) mobile network, two most popular mobile networks, both support multi-frequency. For example, the 4G/LTE mobile network currently covers low frequency (698 MHz to 798 MHz) and high frequency (2300 MHz to 2690 MHz) and expects to integrate other wave bands to provide a higher wave band in the future, such as the frequency band for 5G/Sub6G mobile network. In comparison to the mainstream mobile network, such as the 2G/GSM and 3G/UMTS mobile networks, the 4G/LTE mobile network integrates the 2G/3G/4G frequency band and works with the 5G/Sub6G frequency band. Apart from making relevant technologies sustainable, the 4G/LTE mobile network further provides higher frequency band and higher transmission rate of 5G mobile network and is very attractive to the users.

The dual-frequency antenna of the present embodiment produces satisfactory return loss both in the 4G/LTE frequency band and the 5G/Sub6G frequency band. The dual-frequency antenna of the present embodiment can be used in a terminal device, such as a 4G/5G mobile phone or an in-vehicle communication device, and can support multi-bands, such that the terminal device can operate between different frequency bands and provide the users with more convenience of use.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A transmission structure with a dual-frequency antenna, wherein the transmission structure comprises:

a substrate;

a first radiator having a first electrical connection portion, wherein the first radiator extends from the first electrical connection portion in a first direction and a second direction, and the first direction is opposite to the second direction; and a second radiator having a second electrical connection portion adjacent to the first electrical connection portion, wherein the second electrical connection portion has a first side and a second side, the first side is closer to the first electrical connection portion than the second side, and the second electrical connection portion forms a ground area between the first side and the second side, wherein a length of the ground area is greater than a first set value, wherein the second radiator extends a first adjustment block from the second electrical connection portion in the first direction, and the first adjustment block and a part of the first radiator extending in the first direction are adjacent to each other and are separated by a groove, the second radiator extends a second adjustment block from the second electrical connection portion in the second direction, and the second adjustment block and another part of the first radiator extending in the second direction are adjacent to each other and are separated by another groove, the second adjustment block comprises a first sub-block, a second sub-block and a third sub-block, the first sub-block is located between the second sub-block and the third sub-block, and the second sub-block and the third sub-block extend toward different directions from two opposite sides of the first sub-block.

2. The transmission structure according to claim 1, further comprising a cable disposed on the substrate, wherein the cable is used to feed a signal to the first electrical connection portion, and a feeding direction of the signal is perpendicular to the first direction and the second direction, wherein, the cable overlaps the ground area by an overlapping length greater than a second set value less than or equivalent to the first set value.

3. The transmission structure according to claim 1, wherein the first radiator and the second radiator are integrally formed on the substrate in one piece to form a printed antenna structure.

4. The transmission structure according to claim 1, wherein the first radiator extends a deflection portion and an extension block in the first direction, and the deflection portion is connected between the first electrical connection portion and the extension block.

5. The transmission structure according to claim 1, wherein the first radiator is used to excite an electromagnetic wave of a first wave band, and a length of the first radiator extends in the first direction is ¼ of a wavelength of the first wave band.

6. The transmission structure according to claim 5, wherein the first radiator is used to excite an electromagnetic wave of a second wave band, and a length of the first radiator in the second direction is ¼ of a wavelength of the second wave band.

7. The transmission structure according to claim 1, wherein the second adjustment block is used as a ground surface of the substrate, the first sub-block and the second sub-block form an L-shaped block, and the first sub-block and the third sub-block form a T-shaped block.

8. The transmission structure according to claim 2, wherein the cable comprises a current end and a ground end, the current end is electrically connected to the first electrical connection portion, and the ground end is electrically connected to the second electrical connection portion.

9. The transmission structure according to claim 2, wherein a ratio of the second set value to the first set value is less than or equivalent to 1 and is greater than ½, ⅔ or ¾.

* * * * *